US010455927B2

(12) United States Patent
Brousseau

(10) Patent No.: US 10,455,927 B2
(45) Date of Patent: Oct. 29, 2019

(54) LOOP FOR USE WITH A VARIETY OF HANDHELD DEVICE CASES

(71) Applicant: Jean-Philippe Brousseau, Gatineau (CA)

(72) Inventor: Jean-Philippe Brousseau, Gatineau (CA)

(73) Assignee: GENEZE INNOVATION INC., Chelsea, QC (CA)

( * ) Notice: Subject to any disclaimer, the term of this patent is extended or adjusted under 35 U.S.C. 154(b) by 0 days.

(21) Appl. No.: 15/995,738

(22) Filed: Jun. 1, 2018

(65) Prior Publication Data

US 2018/0271265 A1 Sep. 27, 2018

Related U.S. Application Data

(63) Continuation of application No. 14/663,653, filed on Mar. 20, 2015, now abandoned.
(Continued)

(51) Int. Cl.
*B25G 3/00* (2006.01)
*A45F 5/00* (2006.01)
(Continued)

(52) U.S. Cl.
CPC ..... *A45F 5/10* (2013.01); *B25G 1/00* (2013.01); *B25G 1/02* (2013.01); *B25G 3/00* (2013.01);
(Continued)

(58) Field of Classification Search
CPC ..... A45F 5/10; A45F 2200/055; A45F 2200/0525; A45F 2200/0533;
(Continued)

(56) References Cited

U.S. PATENT DOCUMENTS 3,397,913 A 8/1968 Fein
4,678,205 A 7/1987 Wold
(Continued)

FOREIGN PATENT DOCUMENTS

CA 2885434 C 1/2019
JP 3126188 U 10/2006

OTHER PUBLICATIONS

Interview Record dated Sep. 19, 2018 issued by Canadian Intellectual Property Office in relation to corresponding Canadian Patent Application No. 2,885,434 filed with the Canadian Intellectual Property Office.
(Continued)

*Primary Examiner* — Brian D Nash
(74) *Attorney, Agent, or Firm* — The PatentAgency.ca; Luis P. Estable

(57) ABSTRACT

Disclosed is a loop suitable for a handheld device. A flexible loop is affixed e.g. via adhesive onto a handheld device protective case and serves as a wrist strap for ease of grabbing and prevents accidental drops of the handheld device. A feature for cleaning the handheld device, such as a piece of microfiber cloth, can be integrated on the loop. None of a handheld device's functionality is impaired. A back strap loop is disclosed for holding a device with one hand. Components are highly customizable in regards to color, shape, dimension, print, etc., the overall design of which may help a user to make their handheld device unique, particularly as a promotional item.

24 Claims, 12 Drawing Sheets

Related U.S. Application Data

(60) Provisional application No. 61/968,165, filed on Mar. 20, 2014, provisional application No. 62/135,694, filed on Mar. 19, 2015.

(51) Int. Cl.

| | |
|---|---|
| ***A45F 5/10*** | (2006.01) |
| ***B25G 1/02*** | (2006.01) |
| ***B25G 1/00*** | (2006.01) |
| *A45C 1/06* | (2006.01) |

(52) U.S. Cl.

CPC ..... *A45C 1/06* (2013.01); *A45F 2005/008* (2013.01); *A45F 2200/055* (2013.01); *A45F 2200/0508* (2013.01); *A45F 2200/0516* (2013.01); *A45F 2200/0525* (2013.01); *A45F 2200/0533* (2013.01); *A45F 2200/0558* (2013.01)

(58) Field of Classification Search

CPC ..... A45F 2200/0558; A45F 2200/0516; A45F 2003/006; A45F 2005/008; A45C 1/06; B25G 3/00; B25G 1/00

USPC ..... 224/267, 257, 254, 250

See application file for complete search history.

(56) References Cited

U.S. PATENT DOCUMENTS 4,795,190 A 1/1989 Weightman et al.
4,893,373 A 1/1990 Kato
D308,287 S 6/1990 Miller et al.
5,008,987 A * 4/1991 Armour, II ..... A44B 18/00 24/306
5,160,074 A * 11/1992 Coates ..... A63C 11/025 224/257
5,433,359 A * 7/1995 Flowers ..... A45F 5/00 224/222
5,460,308 A * 10/1995 Hahn ..... A45F 3/14 224/250
6,076,789 A * 6/2000 Jackson ..... A45F 5/02 224/901.4
6,095,390 A 8/2000 Bogle
6,105,923 A * 8/2000 Robertson ..... A45F 5/02 224/257
6,182,485 B1 * 2/2001 Moore ..... E05B 13/002 292/258
6,375,056 B1 4/2002 Henri
6,550,108 B2 4/2003 Pratl
7,650,007 B2 1/2010 Iuliis et al.
7,661,567 B2 2/2010 Myers
7,722,508 B2 * 5/2010 Hetrick ..... A63B 21/0023 482/139
7,774,969 B1 * 8/2010 Silverman ..... H05K 5/0278 224/257
7,778,026 B2 * 8/2010 Mitchell ..... A45C 9/00 206/522
D627,778 S 11/2010 Akana et al.
8,428,644 B1 4/2013 Harooni
8,428,664 B1 4/2013 Wyers
8,523,031 B2 9/2013 Hedrick
8,646,698 B2 * 2/2014 Chen ..... H04B 1/3888 235/492
8,950,638 B2 2/2015 Wangercyn et al.
8,979,716 B1 * 3/2015 Rawlins ..... A63B 21/0442 482/91
9,016,534 B2 * 4/2015 Whitley ..... A45F 5/00 224/254
9,155,377 B2 10/2015 Wangercyn et al.
9,729,186 B1 8/2017 Dill
2002/0166212 A1 10/2002 Pratl
2003/0178461 A1 9/2003 Shattuck
2006/0097019 A1 5/2006 Hayaldree
2006/0144886 A1 7/2006 Gambrill
2008/0127461 A1 6/2008 Linden et al.
2008/0223889 A1 9/2008 RIssell et al.
2009/0194571 A1 8/2009 Evans
2011/0031287 A1 2/2011 Le Gette et al.
2013/0239990 A1 9/2013 Lynch
2014/0027482 A1 1/2014 Crawford et al.
2014/0148295 A1 5/2014 Ishizuka
2014/0326774 A1 11/2014 Coleman
2015/0076185 A1 3/2015 Sartee et al.
2015/0108185 A1 4/2015 Polytaridis et al.
2016/0249732 A1 9/2016 Henry

OTHER PUBLICATIONS

Lily Truong, Canadian Examiner Requisition for corresponding application 2885434 dated Aug. 2, 2018 (Note: The Canadian Examiner Did Not Object to Claims Corresponding to Claims 1,3-25 of Present Application).

* cited by examiner

LOOP FOR USE WITH A VARIETY OF HANDHELD DEVICE CASES

CROSS-REFERENCE TO RELAYED APPLICATIONS

The present application is related to, and is a continuation of, U.S. non-provisional patent application Ser. No. 14/663,653, filed Mar. 20, 2015, for LOOP SUITABLE FOR USE WITH A VARIETY OF OBJECTS, by Jean-Philippe Brousseau, included by reference herein and for which benefit of the priority date is hereby claimed.

TECHNICAL FIELD

This application relates to attachment mechanisms and methods of use thereof, and more particularly to a loop for use with a variety of handheld device cases, in particular.

BACKGROUND OF THE APPLICATION

U.S. patent application Ser. No. 09/894,596 filed 28 Jun. 2001 for "ATTACHMENT LOOP FOR A HANDHELD DEVICE" by Michael J. Pratl discloses an attachment loop for affixing to a handheld device. The attachment loop includes a self-adhesive base panel having a ring portion pivotally attached thereto. A segment of the ring portion is captured within a channel of the base panel. The base panel has an end profile generally matching the inside opening profile of the ring portion to permit the ring portion to lay flush against the surface of the handheld device.

U.S. patent application Ser. No. 11/212,514 filed 24 Aug. 2005 for "LANYARD FOR HANDHELD ELECTRONIC DEVICE" by Daniele De Iuliis et al discloses a lanyard for carrying or wearing portable electronic devices. The lanyard includes a neck cord having data carrying capabilities. The lanyard also includes a harness that physically holds and operatively couples the portable electronic device to the neck cord. When a portable electronic device is coupled to the harness, the portable electronic device can be worn around a neck and communicate with an input and/or output (I/O) device (e.g., earphones) operatively coupled to the data carrying cord. That is, the I/O device can send data through the neck cord to the portable electronic device and/or receive data being carried by the neck cord from the portable electronic device. The lanyard facilitates greater ease in wearing portable electronic devices and enables better approaches for managing wires between portable electronic devices and peripheral I/O devices.

U.S. patent application Ser. No. 11/543,331 filed 5 Oct. 2006 for "STICK-ON SECURITY RING FOR A HAND HELD DEVICE" by Gregory B. Myers discloses a button that provides an adhesive flat bottom surface for attachment to a cell phone or similar hand held device. A leash extends from the button and terminates with a finger ring. When the device is held in a hand with one finger secured in the ring, the device is secured in the hand so that it is less likely to fall. The ring may be an extension of the leash, both a part of an elastic cord loop where the leash is secured within the button and the ring extends away from the button. The leash may be retractable.

U.S. patent application Ser. No. 13/316,074 filed 9 Dec. 2011 for "LANYARD APPARATUS FOR CARRYING DEVICES" by Shane Hedrick discloses an apparatus for carrying hand held electronic and other types of devices that includes a flexible substrate and a lanyard secured to the substrate. The substrate has opposite first and second surfaces and opposite first and second end portions. A layer of adhesive material is applied to at least a portion of the substrate first surface, and a protective layer of material is releasably secured to the adhesive material. When the protective layer is removed, the adhesive material is exposed such that the substrate can be secured to a device via the adhesive material. The adhesive material is intended to securely attach the substrate to the device and such that removal therefrom is difficult. The lanyard allows for the substrate and an attached device to be suspended around the neck of a user.

U.S. patent application Ser. No. 13/316,376 filed 9 Dec. 2011 for "LEASH FOR AN ELECTRONIC DEVICE" by Kenneth Y. Minn et al discloses a leash for an electronic device, with a data port, comprising: a connector; a singular cord; an elastomeric coating; a protective element; and a washer. The connector includes a broad face, an insertable member adjacent to the broad face and configured to engage the data port, and a latch configured to selectively lock the insertable member to the data port. The singular cord includes a first and second end and defines a spring-loop junction therebetween, wherein the second end is arranged proximal to the spring-loop junction to form a loop. The elastomeric coating is arranged over the cord between the first end and the spring-loop junction and defines a spring section therebetween. The protective element is arranged over the spring-loop junction and the second end of the cord. The washer couples the first end to the connector, the cord extending from the broad face of the connector.

The shortcomings of the aforementioned existing solutions may be three-fold. First, some solutions may involve mechanical apparatus including metallic or plastic parts that may be too bulky or expensive to manufacture. Second, some solutions may be relatively less bulky, yet still may require some significant expense in manufacturing due to the use of components that need to be assembled, for example sewn together; they also may require significant non-recurrent engineering in order to accommodate different devices of the same class, such as cellular or smart phones. Third, some solutions may require significant non-recurrent engineering in order to accommodate different classes of handheld devices for different applications; some solutions provide points of attachment for lanyards to be worn around the neck, other solutions provide points of attachment for anchoring to the body, yet other solutions provide for a strap to be held by the hand via a ring on the hand.

SUMMARY

According to an aspect of the present application, there is provided: a loop suitable for use with a protective case for a handheld device, the loop including: a strap having a top end and a bottom end folded-over and affixed to each other thereby forming a front side, a backside, an outside face, and an inside face of the loop; a self-adhesive portion provided at the top end and the backside of the loop suitable for affixing the loop to the case or device; and a microfiber cloth provided in a clasp that wraps around the strap like a tube or a portion of the strap. The bottom end of the loop hangs loose, such as a standard wrist strap would do, when the loop is affixed to the case or device.

According to another aspect of the present application, there is provided a loop suitable for use with a protective case for a handheld device, the loop including: a strap having a top end and a bottom end and a portion in-between; a first self-adhesive portion provided at the top end, bottom end, or the portion in-between; a second self-adhesive portion provided at the top end, bottom end, or the portion in-between. The first and second self-adhesive portions are suitable for affixing the strap to the protective case thereby forming the loop.

According to yet another aspect of the present invention, there is provided: a loop suitable for use with a protective case for a handheld device, the loop including: a strap having a top end and a bottom end; an affixing portion including a self-adhesive portion provided at the top end, bottom end, or in-between the top end and the bottom end, of the strap. The strap is folded-over to form the loop. The affixing portion provides at least one strap-affixing portion suitable for affixing the loop to the protective case.

In some embodiments, the length of the loop is suitable for an average human to use the bottom end of the loop as a wrist strap or an attachment to a cord, chain, carabineer, retractable reel, ring, or leather strap.

In some embodiments, a microfiber cloth is integrated in the loop in a clasp that wraps around the strap like a tube, or in a portion of the strap.

In some embodiments, the material of the loop is elastic, inelastic, plastic, polyester ribbon, microfiber, card, paper, kraft paper, or high-density polyethylene fibres.

In some embodiments, the width of the strap is suitable for passing a portion of the strap in an opening in a protective case for a handheld device.

In some embodiments, a portion the strap is made from a material flexible enough and thin enough to have a thickness that is suitable for conforming a portion of the strap that includes the strap-affixing portion between two parts of an assembly.

In some embodiments, the two ends of the strap are joined together to form the top end of the loop by a junction.

In some embodiments, the junction is provided by heat welding, ultrasonic welding, adhesive transfer, tape, glue or fastener.

In some embodiments, the junction is a simple fold or a cross fold.

In some embodiments, the top end of the loop has a tip that is an angle cut, V cut, straight cut, glue, or fold.

In some embodiments, the top end of the loop matches an exterior profile of curvature of a device.

In some embodiments, the loop includes a pattern, color, texture, brand mark, logo, drawing, writing, identifying the loop, trademark, branding icon, acronym or slogan.

In some embodiments, the strap includes an accessory such as a bead, ring, clip, ornament, reel, leash, chain, or key ring.

In some embodiments, the loop resists a human pulling force.

In some embodiments, the loop includes a packaging solution with a card or a protective liner, such that the loop is temporarily affixed to one the card or the protective liner for packaging purposes.

In some embodiments, the handheld device is a mobile phone, smartphone, tablet, electronic book, camera, remote control, or portable diabetes device.

In some embodiments, the affixing portion includes a second self-adhesive layer, hook, T shaped tab, permanent affixing element, or releasable affixing element. The affixing portion has adequate strength to support a weight of the handheld device to ensure that a junction between the loop and the protective case remains intact if the loop is pulled.

In some embodiments, includes a clasp that wraps around the strap like a tube.

In some embodiments, the affixing portion is provided by a self-adhesive layer that is non-permanent and non-marking so an integrity of the protective case where it is affixed is preserved, yet strong enough to resist shear forces of the order of a human pulling force.

In some embodiments, the loop includes an other affixing portion provided at the bottom end, top end, or in-between the top end and the bottom end, of the strap.

In some embodiments, the one affixing portion and the other affixing portion are suitable to be affixed to a workpiece thereby providing the loop.

In some embodiments, the workpiece is at a protective case for the handheld device, or the strap.

In some embodiments, the strap is affixed to the protective case via an opening in the protective case such as a feature opening or an opening intended to receive the handheld device for which the protective case provides protection.

In some embodiments, the feature opening is a speaker opening, a camera opening, a data port opening, or an other opening.

In some embodiments, the size of the loop is adjustable to the size of a hand of a person.

In some embodiments, the loop enables a person to operate the handheld device with one hand, locate the handheld device, pull the handheld device, wear and secure the handheld device on a wrist, hand or fingers, use the handheld device in a hands-free fashion, use the handheld device in a hands-relaxed manner, or prevent the handheld device from falling.

In some embodiments, the loop further provides a printing area for a wristband identification marker or other designs.

Some embodiments of the present application provide an aftermarket loop accessory, compatible with any kind of handheld device.

Some embodiments further provide a cleaning apparatus for dirty surfaces.

Furthermore, by offering a highly customizable design, some embodiments of the present application also addresses the need for a user to customize his or her handheld device, and are particularly suitable as promotional items.

Some embodiments of the present application pertain to improved approaches for manipulating, cleaning and customizing a portable item, such as mobile phones.

In one aspect, some embodiments of the present application provide an apparatus for affixing to a handheld device. The loop acts as an add-on leash that matches and fits almost every variety of handheld devices, such as, but not limited to, smartphones.

In another aspect, some embodiments of the present application relates to making handheld devices easier to secure on the body of the user, such as on wrist and fingers, providing an apparatus that prevents the handheld device from drops, losses, snatch thefts, etc. The loop also helps to locate, grab and pull out the handheld device from one's pocket, jacket, purse, etc. Additionally, some embodiments of the present application allow a method of connecting a handheld device to an external support element, such as a ring, a carabineer, etc.

In still another aspect, some embodiments of the present application provide a method for cleaning any smooth surface, such as lenses and touch screens. Some embodiments of the present application enable a user to carry a cleaning apparatus, affixed on his or her handheld device where cleaning is needed.

In yet another aspect, some embodiments of the present application offer a solution for customizing one's handheld device. Since components of the present application are highly customizable, they provide a way to create multiple different models, including versions with acronyms, slogans, patterns, logos, symbols, brand marks, etc.

Other aspects and features of the present invention will become apparent to those ordinarily skilled in the art upon review of the following description of specific embodiments of a loop for use with a variety of handheld device cases in conjunction with the accompanying drawing figures.

BRIEF DESCRIPTION OF THE DRAWINGS

Embodiments of the present application will now be described, by way of example only, with reference to the accompanying drawing figures, wherein.

Like reference numerals are used in different figures to denote similar elements.

DETAILED DESCRIPTION OF THE DRAWINGS AND PREFERRED EMBODIMENT

Figure 1:
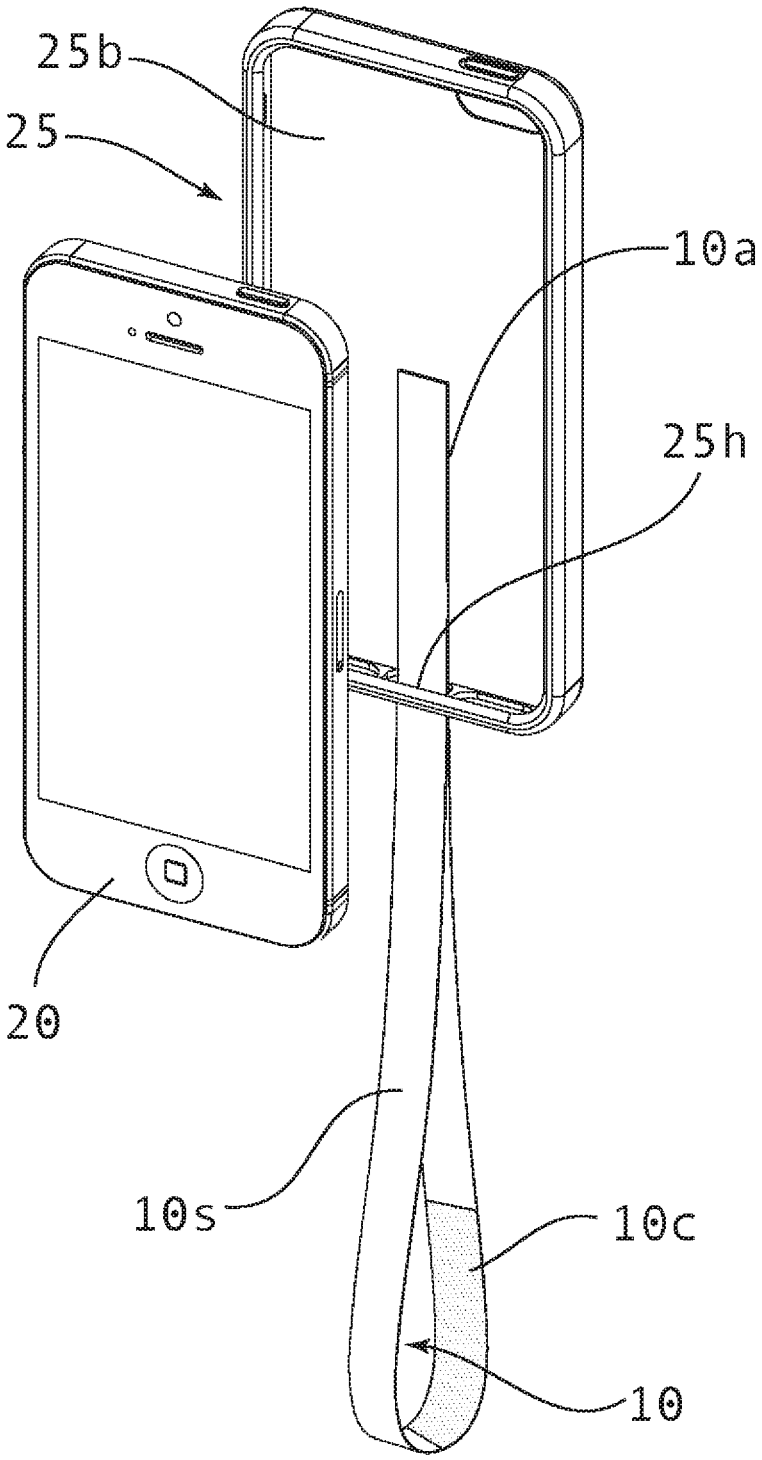
FIG. 1 is an exploded perspective view of an example loop affixed onto an example protective case of an example smartphone, provided according to an embodiment of the present application.

Some embodiments of the present application will be described hereinafter. Although some embodiments of the present application are described in terms of specific illustrative example embodiments, it is to be understood that the embodiments described herein are by way of example only and that the scope of the embodiments of the present application is not intended to be limited thereby.

Referring now to the drawing figures, it is noted that like reference numerals represent like parts.

FIG. 1 is an exploded perspective view of an example loop 10 affixed onto an example protective case of an example smartphone, provided according to an embodiment of the present application. The loop 10 includes a top end and a bottom end, a front side and a backside, and an outside face and an inside face. The loop 10 is preferably made of a thin and flexible strap 10*s* and includes a strap self-adhesive layer 10*a* (at least one affixing portion, a strap-affixing portion) on its top end backside that sticks onto the handheld protective case 25 and in some embodiments onto the inside face of the protective case 25*b*. While the top end of the loop 10 is affixed, the bottom end of the loop 10 passes through an opening in the protective case 25*h*, and hangs loose, such as a standard wrist strap would do. As illustrated, the loop 10 also includes an optional feature for cleaning the device, illustrated as a microfiber cloth 10*c*, integrated on the inside of the strap 10*s*. In preferred forms, embodiments of the present application are convenient to use, and fit flush on the surface of the device to which it is affixed.

The strap 10*s* is made from a material flexible enough, and thin enough to seamlessly integrate a handheld device and/or be squeezed in-between two parts, such as a smartphone handheld device 20 and its handheld protective case 25. Suitable materials shall resist a human pulling force. For example, polyester ribbon may be appropriate. The strap 10*s* is folded onto itself to close a loop 10. Both ends of the strap 10*s* are joined together to form the top end of the loop 10. That junction may be permanent, and thus manufactured by, but not limited to, one of: heat welding, adhesive transfer tape, glue, etc. Illustrated strap 10*s* shows a simple fold over assembly, but some embodiments may have any kind of twist within the strap 10*s*, such as ribbon cross folds. Although not expressly shown in the drawings, in some embodiments, the ends of the strap 10*s* after the fold over assembly are more or less flush with one another, depending on the application. In other embodiments, at least one end of the strap 10*s* is left uncovered after the fold over assembly, such as for example to leave a section of adhesive transfer tape exposed on the uncovered portion of the at least one end of the strap 10*s*. Although not expressly shown in the drawings, in some embodiments, the top end of the loop 10 may have any kind of angle cut, V cut, straight cut, etc.

As the top end of the loop 10 matches the exterior profile of curvature of the device, the bottom end of the loop 10 that hangs freely by the device must resist a human pulling force. In preferred form, the length of the loop's top end is as short as possible, for minimal footprint on the device where it is affixed, and the length of the loop's bottom end allows a user to comfortably grab and slip onto his or her wrist. A length of more or less six inches is enough for an average human to use the bottom end of the loop 10 as a wrist strap 10*s*. In another preferred form, the bottom end of the loop 10 presents a minimal length that allows attachment to any type of cord, chain, carabineer, retractable reel, thicker leather strap and the like. Some embodiment implies that the loop 10 passes through a specific hole, such as a data port opening or other like opening in the protective case 25*h*, without altering its functionality, and therefore restricts some embodiments of the strap 10*s* to a maximum width and thickness for some applications. Advantageously, a person of ordinary skill in the art is enabled by the present application to select a suitable width of a strap 10*s* for a large class of handheld devices on the basis of the minimal size of the opening in the protective cases for that class of handheld devices, which in turn can be determined by looking at the minimal size of features of a class of handheld device 20 that would require a corresponding suitably sized opening in the protective case 25*h*. Likewise advantageously, a person of ordinary skill in the art is enabled by the present application to select a suitable thickness of a strap 10*s* for a large class of handheld devices on the basis of the tolerances in the space between a large class of handheld devices and their corresponding protective cases.

In some embodiments, the strap 10*s* may feature different patterns, colors, textures, brand marks, logos, acronyms, slogans, etc. It may also offer a space for drawing, writing, identifying the loop 10, etc. Even more, it may feature beads and all sort of montage.

Furthermore, as camera lenses, glasses, and touch screens tend to get dirty, some embodiments of the present application offer a solution for cleaning such surfaces. The loop 10 here features a section of microfiber cloth 10*c* on the inside of the strap 10*s*, to allow a user to clean the touch screen of the handheld device 20, whenever needed. The way of affixing such a fabric are various, for example, pressure sensitive adhesive transfer tape, thermo adhesive fabric, sewing, etc. Such a cleaning feature is not limited to a single section of fabric; although not expressly illustrated, it may be integrated all around the strap 10*s*, inside and/or outside. In fact, the strap 10*s* itself may be made of microfiber material. Moreover, other forms of integration of a cleaning microfiber cloth 10*c* are also possible and are contemplated as embodiments of the present application.

Figure 2A:
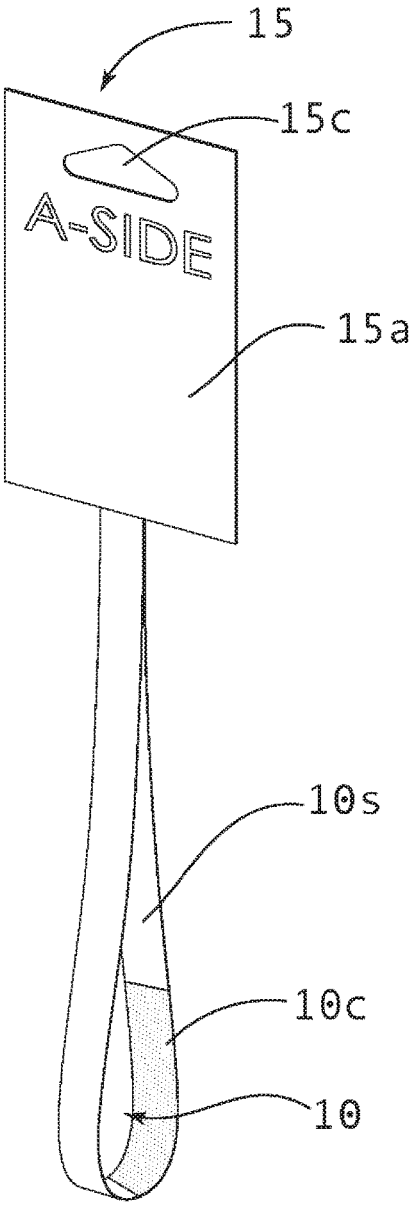
FIG. 2A is a front perspective view of the exemplary loop of FIG. 1, affixed onto an example packaging solution, provided according to an embodiment of the present application.
Figure 2B:
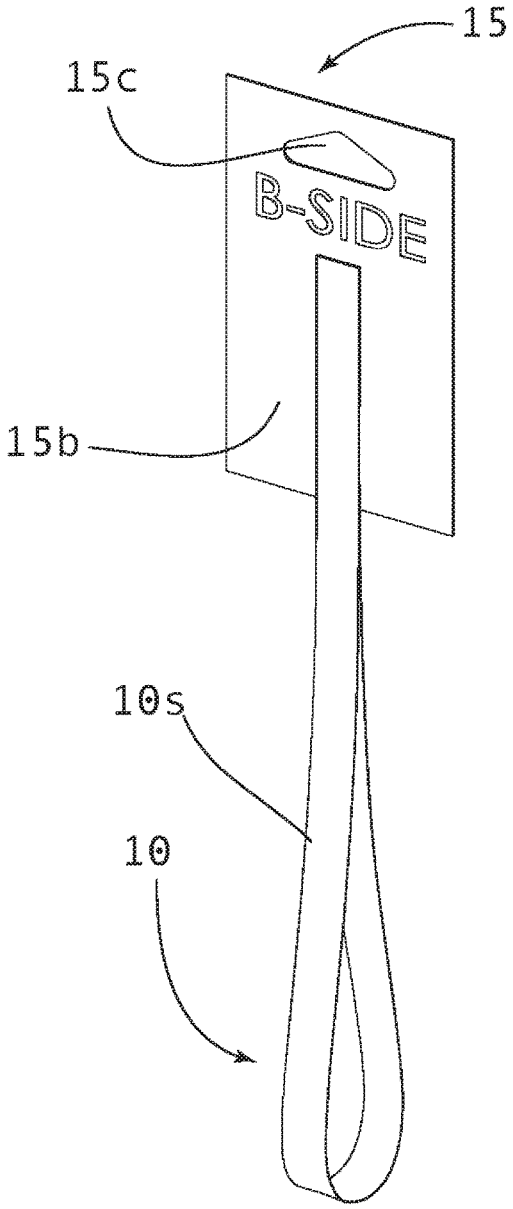
FIG. 2B is a rear perspective view of the example loop and example packaging solution of FIG. 2A.

FIG. 2A is a front perspective view of the exemplary loop 10 of FIG. 1, affixed onto an example packaging solution, provided according to an embodiment of the present application. FIG. 2B is a rear perspective view of the example loop 10 and example packaging solution of FIG. 2A. Card 15 provides for an embodiment including a packaging solution. The card 15 features an A-SIDE 15*a* and a B-SIDE 15*b* that are meant to show brand marks, logos, information, drawings, instructions for applying the loop 10, etc. The loop 10 is temporarily affixed to the card 15 (e.g. with adhesive, wrapped around, or otherwise) for packaging purposes. The card 15 is fully customizable with many shapes, colours, and printed material. One embodiment features a cut out 15*c* for hanging the product, as seen on retail stands. Different cut out 15*c* patterns may also exist to hold the loop 10 on the card 15.

Components of embodiments of the present application are highly customizable in terms of materials, colors, prints, branding, shapes, textures, etc. As illustrated in FIG. 2A-2B, some embodiments of the present application are particularly suitable as an original, new and useful promotional item, or as a simple aftermarket accessory. The overall design of the loop 10 in some embodiments, including packaging, advantageously involves very few parts and optimal manufacturing processes to ensure minimal cost of fabrication.

Exemplary handheld devices that may be carried by the loop 10 include, but are not limited to, electronic devices such as mobile phones, tablets, electronic books, cameras, remote controls, portable diabetes devices, etc. FIGS. 1,5, 6,8-11 illustrate embodiments of the loop 10 affixed to different classes of handheld devices. For example, FIG. 6 illustrates an embodiment of the loop 10 squeezed in between a tablet 90 and its tablet protective case 95. FIGS. 1, 2A, 2B, 5, 6, 8-11 illustrate substantially the same loop 10 affixed to a handheld device 20 case, a card 15, a strap protective liner 101, a handheld device with feature 60, and a tablet 90 and/or tablet protective case 95 respectively. Advantageously, a user could elect to detach the loop 10 from one handheld device and attach it to another handheld device.

Figure 3A:
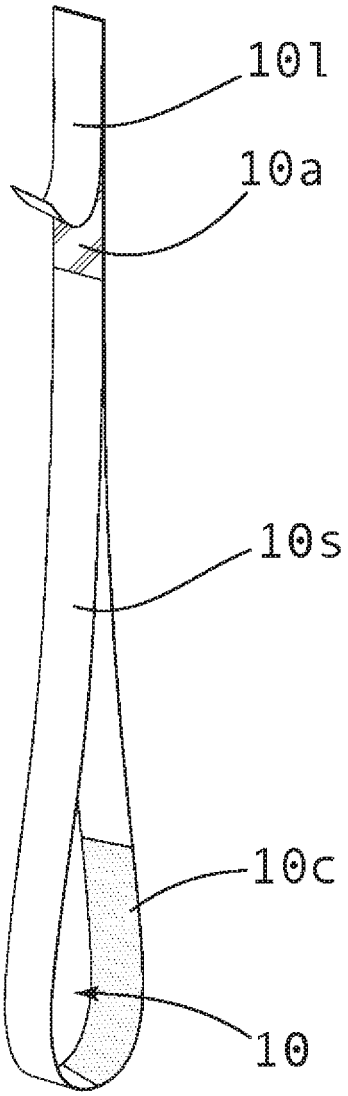
FIG. 3A is a perspective backside view of the example loop of FIGS. 2A-2B, wherein a protective liner is being peeled off from a self-adhesive layer of the loop and wherein a microfiber cloth is integrated on the strap of the loop, provided according to embodiments of the present application.
Figure 3B:
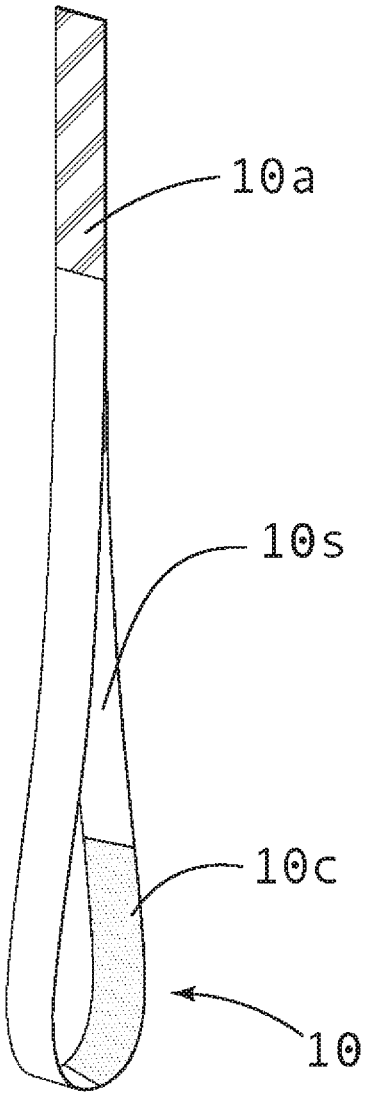
FIG. 3B is a perspective backside view of the example loop of FIG. 3A, with the self-adhesive layer fully exposed, provided according to an embodiment of the present application.

FIG. 3A is a perspective backside view of the example loop 10 of FIGS. 2A-2B, wherein a protective liner is being peeled off from a self-adhesive layer of the loop 10 and wherein a microfiber cloth 10*c* is integrated on the strap 10*s* of the loop 10, provided according to embodiments of the present application. FIG. 3B is a perspective backside view of the example loop 10 of FIG. 3A, with the self-adhesive layer (at least one affixing portion, strap-affixing portion) fully exposed, provided according to an embodiment of the present application. In some embodiments, the card 15 of FIGS. 2A-2B may also directly serve as the protective liner for the strap self-adhesive layer 10*a*, so when the loop 10 and the card 15 are separated, the strap self-adhesive layer 10*a* is exposed.

As illustrated in FIG. 3A, when the strap protective liner 101 is removed, the self-adhesive layer is uncovered and ready to be applied on any surface. No additional operation shall be required from a user in order to apply and use the loop 10. In one embodiment, the loop 10 can either be stuck to a device or its protective case, as in for example FIG. 1, FIG. 5 and FIG. 6. In another embodiment, as illustrated in FIG. 6, the top end of the loop 10 may be folded over itself to wrap on a key ring 70.

Although not expressly shown in the drawing, alternatively, the loop 10 is affixed to the handheld device 20 or its handheld protective case 25 by other mechanical elements, such as, but not limited to, another self-adhesive layer, hooks, T shaped tabs, fasteners, and/or by other permanent affixing element or releasable affixing element. It may also be an integral part of the design of a device, such as a handheld protective case 25. The affixing technique is selected to ensure adequate strength to support the weight of the handheld device 20 and to ensure that the connection between the attachment loop 10 and the handheld device 20 remains intact if the loop 10 is pulled. Some embodiments of the present application provide greater safety, prevent drops and losses, and improve ease of reach within pockets, jackets, purses, car seats, etc.

Figure 4:
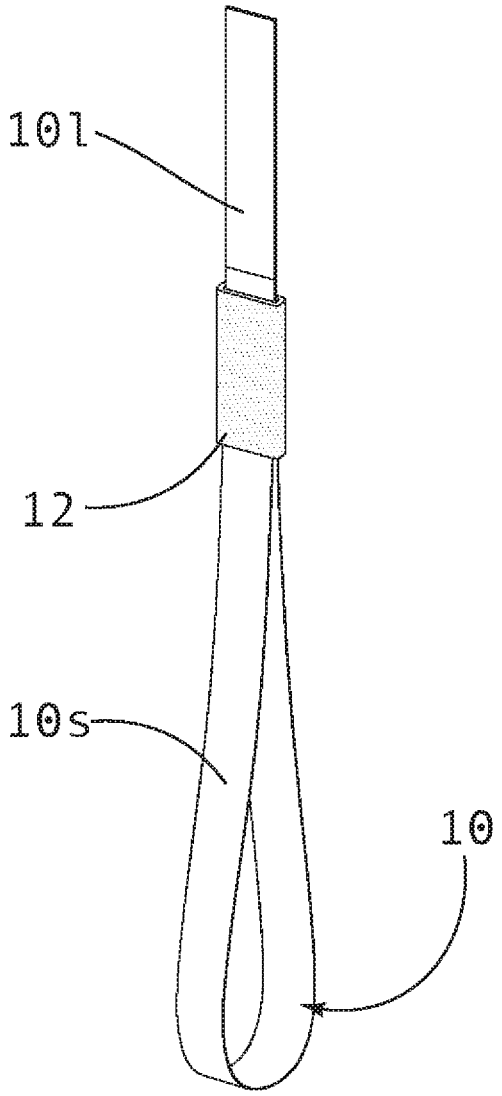
FIG. 4 is a perspective backside view of an another example loop with another example microfiber cloth integration aspect, as a clasp tube, provided according to an embodiment of the present application.

FIG. 4 is a perspective backside view of another example loop 10 with another example microfiber cloth 10*c* integration aspect, as a clasp tube, provided according to an embodiment of the present application. As illustrated in FIG. 4, an adjustable clasp 12 made of microfiber cloth 10*c* wraps around the strap 10*s* like a tube. The clasp 12 slides freely on the strap 10*s* and serves as a microfiber cloth 10*c*. In some embodiments, a standard clasp may also be integrated as a simple adjustable feature for the loop 10, without any cleaning purpose. As illustrated, a double-sided adhesive tape has been transferred with its protective liner to the top end backside of the strap 10*s* thereby providing the strap protective liner 101. In some embodiments, the strap protective liner 101, such as kraft paper, may feature drawings, information, logos, acronyms, etc.

Figure 5:
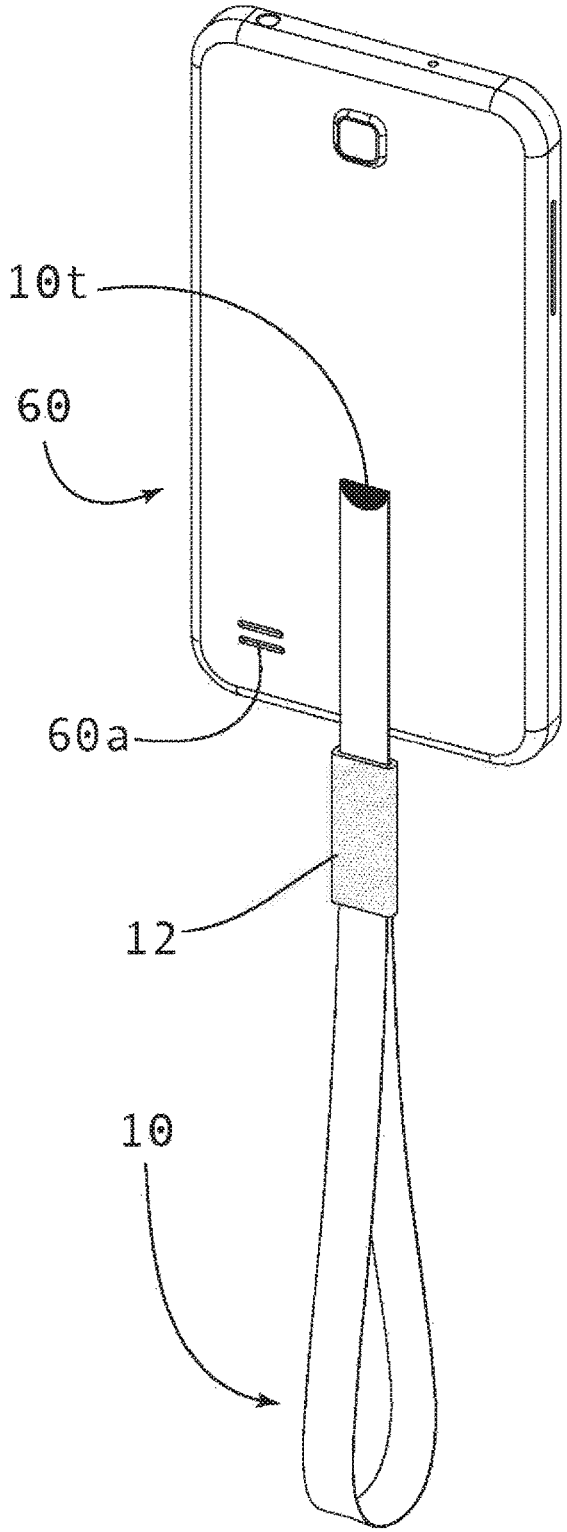
FIG. 5 is a perspective view of a variation of the example loop of FIG. 4 affixed on another example smartphone, provided according to an embodiment of the present application.
Figure 6:
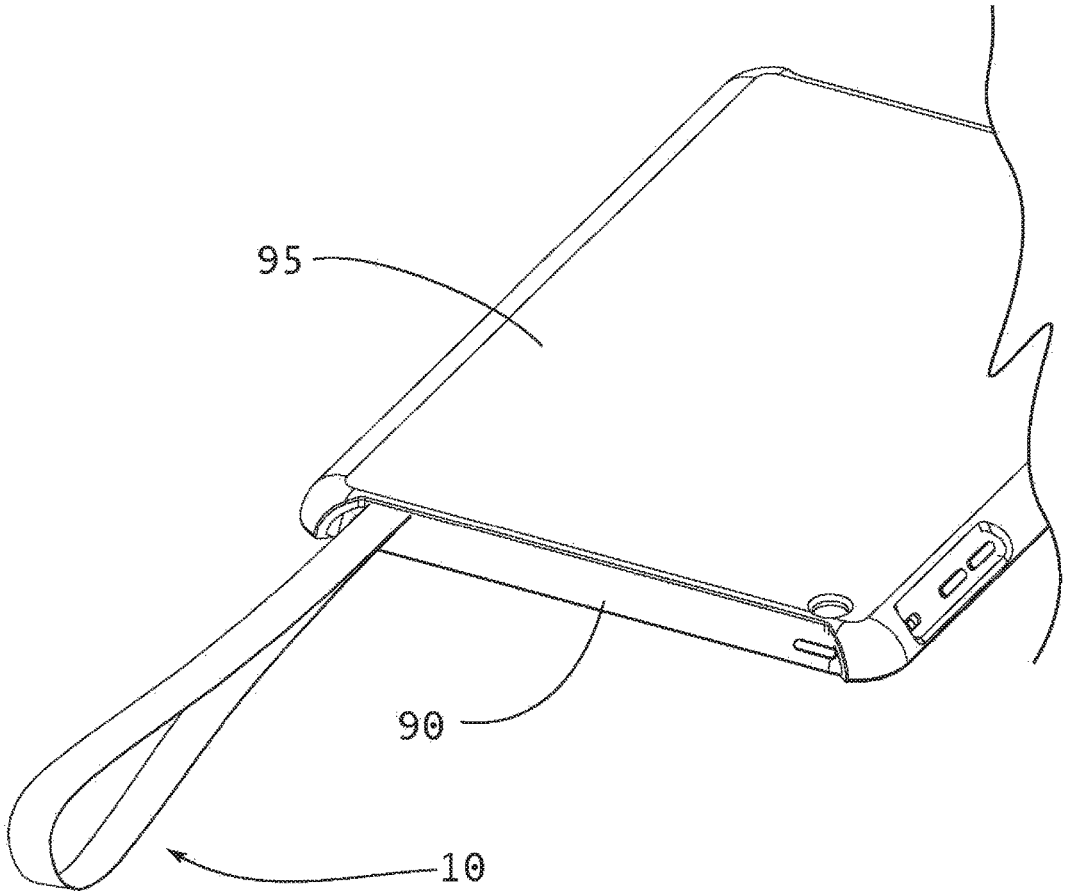
FIG. 6 is a perspective view of the example loop of FIG. 4 fitted between an example tablet computer and its example protective case, provided according to an embodiment of the present application.

FIG. 5 is a perspective view of a variation of the example loop 10 of FIG. 4 affixed on another example smartphone, provided according to an embodiment of the present application. As the top end of a ribbon tends to fray, some embodiments of the present application may also have a folded tip 10*t*, as illustrated in FIG. 5, to seal the end. Such a tip 10*t* may also serve as an aesthetic feature and/or represent a branding icon or trademark. As illustrated in FIG. 5, a tip 10*t* in that example is made of a self-adhesive dot, folded over the top end of the loop 10. Although not expressly shown in the drawings, a heat-cut or some glue can play those roles too. The loop 10 is preferably affixed to the handheld device with feature 60 by pressure-sensitive adhesive, such as a self-adhesive layer 10A. In preferred forms, the adhesive may be non-permanent and non-marking, so the integrity of the device where it is affixed is preserved. To ensure seamless integration on the device, the thickness of the strap self-adhesive layer 10*a* is minimal, but strong enough to resist shear forces. The strap self-adhesive layer 10*a* is intended to securely fix the loop 10 to the device itself or its handheld protective case 25, so it withstands a human pulling force. The adhesive may also be repositioned by peeling off the loop 10 from the device, without damaging any surface. Some embodiments of the present application seamlessly integrate the handheld device so none of its function is impaired. As many models of handheld devices exist, features like speakers, cameras, buttons and ports shall not be obstructed. The one-size fits all solution must have a minimum foot print on the handheld device for a seamless integration. For example, referring to FIG. 5, the loop 10 is affixed on the back of a handheld device with feature 60, without compromising the speaker feature 60*a* thereof.

FIG. 6 is a perspective view of the example loop 10 of FIG. 4 fitted between an example tablet 90 computer and its example protective case, provided according to an embodiment of the present application. Although not expressly shown in the drawing, in alternative embodiments, the loop 10 can be affixed to the tablet 90, the tablet protective case 95, or both. The same applies to the handheld device 20 and handheld protective case 25.

Figure 7:
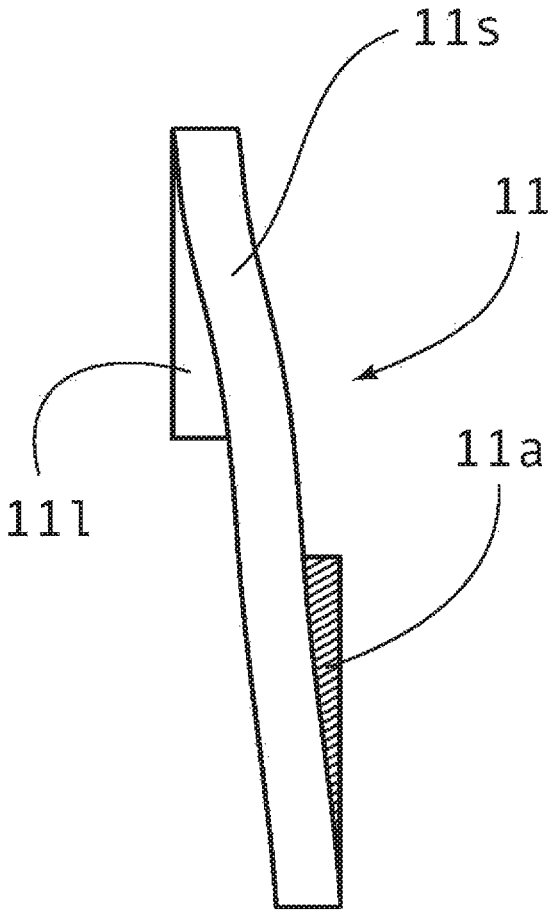
FIG. 7 is a front view of an example back strap loop, with an example protective liner to cover a self-adhesive layer on the back strap loop, provided according to an embodiment of the present application.

FIG. 7 is a front view of an example back strap loop 11, with an example protective liner to cover a self-adhesive layer on the back strap loop 11, provided according to an embodiment of the present application. Compared with the loops so far described, the embodiment of the back strap loop 11 illustrated in FIG. 8 features a back strap 11*s* having two ends that are not assembled to each other. As illustrated, the back strap 11*s* has a back strap self-adhesive layer 11*a* (at least one affixing portion, strap-affixing portion) that is exposed at the bottom end, and a back strap self-adhesive layer 11*a* that is covered by a back strap protective liner 111 at the top end.

Figure 8:
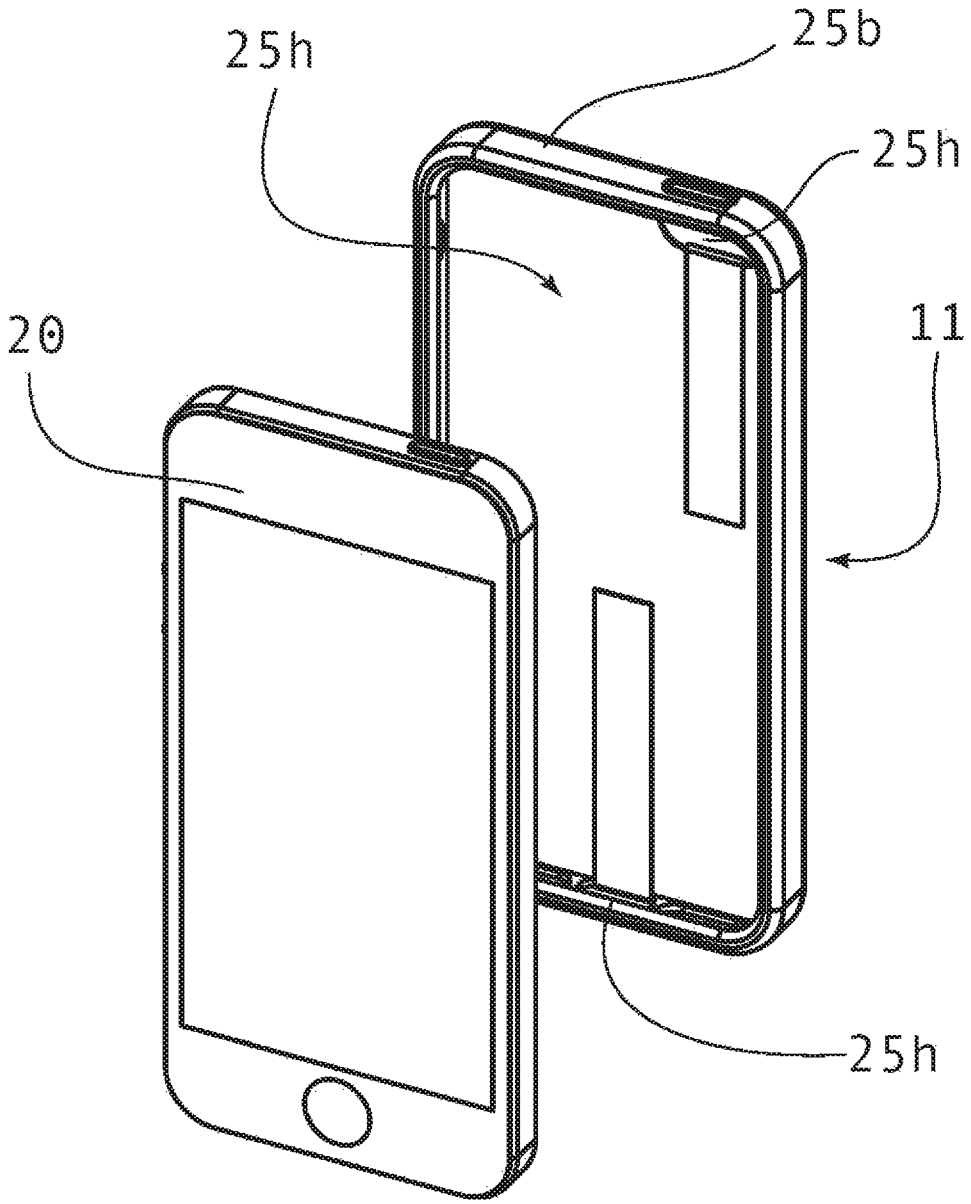
FIG. 8 is a perspective view of an integration of the example back strap loop of FIG. 7 onto the example protective case inside face of FIG. 1 and example smartphone of FIG. 1, provided according to an embodiment of the present application.

FIG. 8 is a perspective view of an integration of the example back strap loop 11 of FIG. 7 onto the example protective case inside face of FIG. 1 and example smartphone of FIG. 1, provided according to an embodiment of the present application. Advantageously, the back strap loop 11 is formed when each of the two back strap self-adhesive layer 11*a* are assembled to a workpiece, which as illustrated in this embodiment is the handheld protective case 25. Advantageously, the width of the back strap 11*s* is smaller than the smallest of each of the two opening in the protective case 25*k* Each of the two ends of the back strap 11*s* having a back strap self-adhesive layer 11*a* is fed through each of the two opening in the protective case 25*h* such that the two back strap self-adhesive layer 11*a* are adhered to the inside face of the protective case 25*b* thereby assembling the back strap loop 11.

Figure 9A:
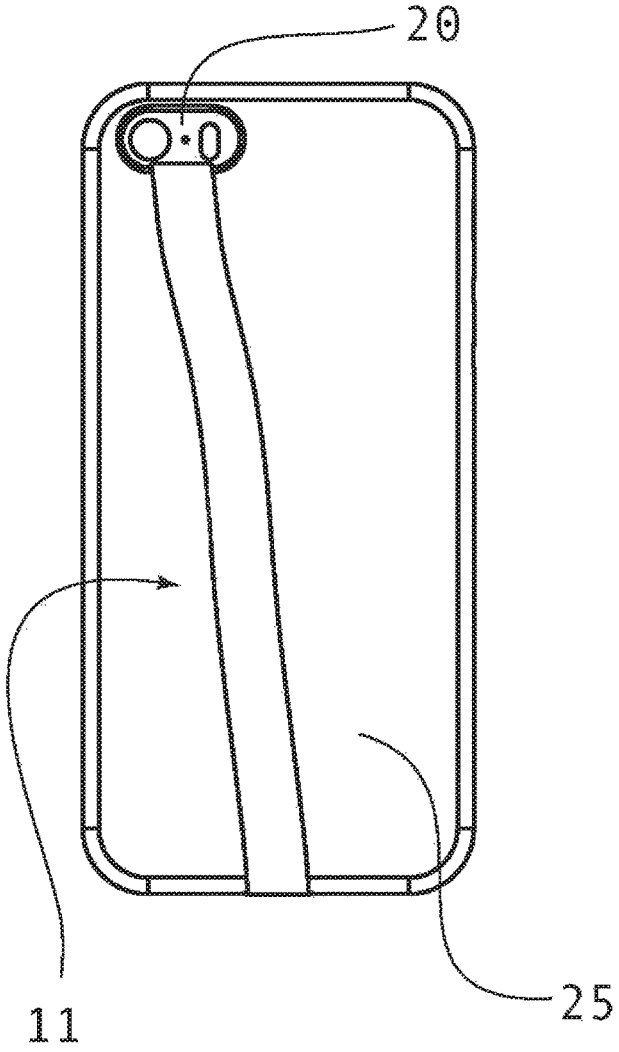
FIG. 9A is a back view of an assembly of the example back strap loop of FIG. 7, example protective case of FIG. 8, and example smartphone of FIG. 8, provided according to an embodiment of the present application.
Figure 9B:
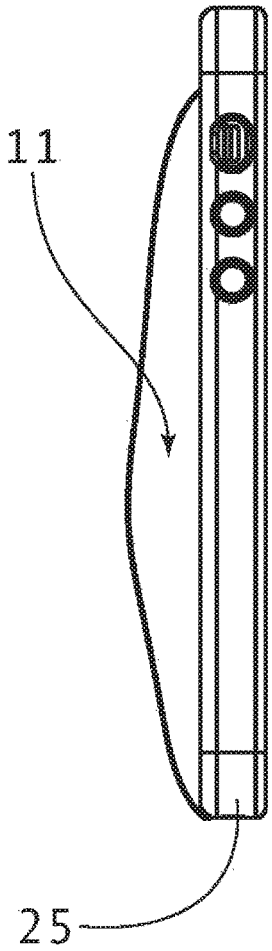
FIG. 9B is a right side view of the assembly of the example back strap loop of FIG. 9A, example protective case of FIG. 9A, and example smartphone of FIG. 9A, provided according to an embodiment of the present application.

FIG. 9A is a back view of an assembly of the example back strap loop 11 of FIG. 7, example protective case of FIG. 8, and example smartphone of FIG. 8, provided according to an embodiment of the present application. FIG. 9B is a right side view of the assembly of the example back strap loop 11 of FIG. 9A, example protective case of FIG. 9A, and example smartphone of FIG. 9A, provided according to an embodiment of the present application. As illustrated, two opening in the protective case 25*h* corresponding to features of the handheld device 20 were re-used, and are readily available in many classes of handheld protective case 25 for a plethora of handheld device 20: the camera port and the data port respectively. In other embodiments, other opening in the protective case 25*h* can be used for this purpose.

Figure 10:
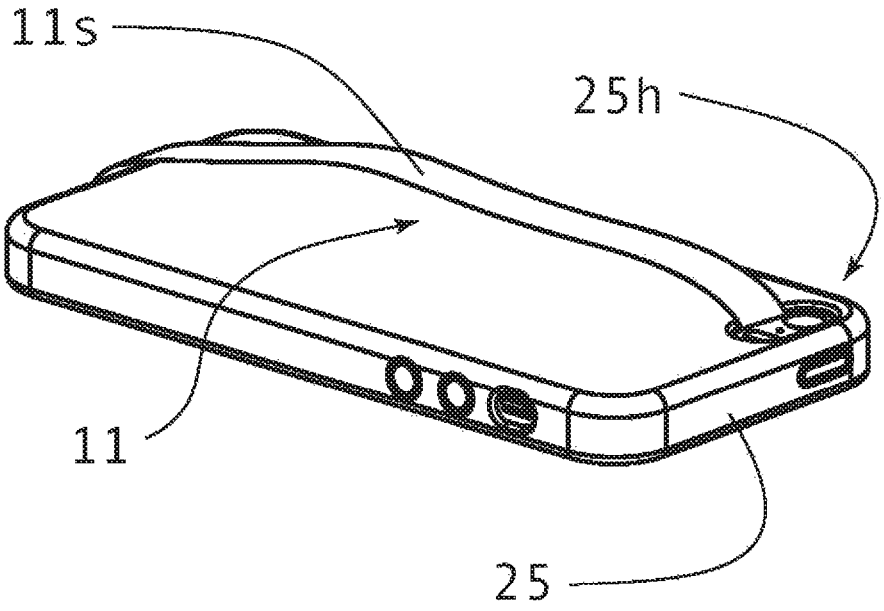
FIG. 10 is a perspective view of the assembly of the example back strap loop of FIG. 9A, example protective case of FIG. 9A, and example smartphone of FIG. 9A, provided according to an embodiment of the present application.
Figure 11:
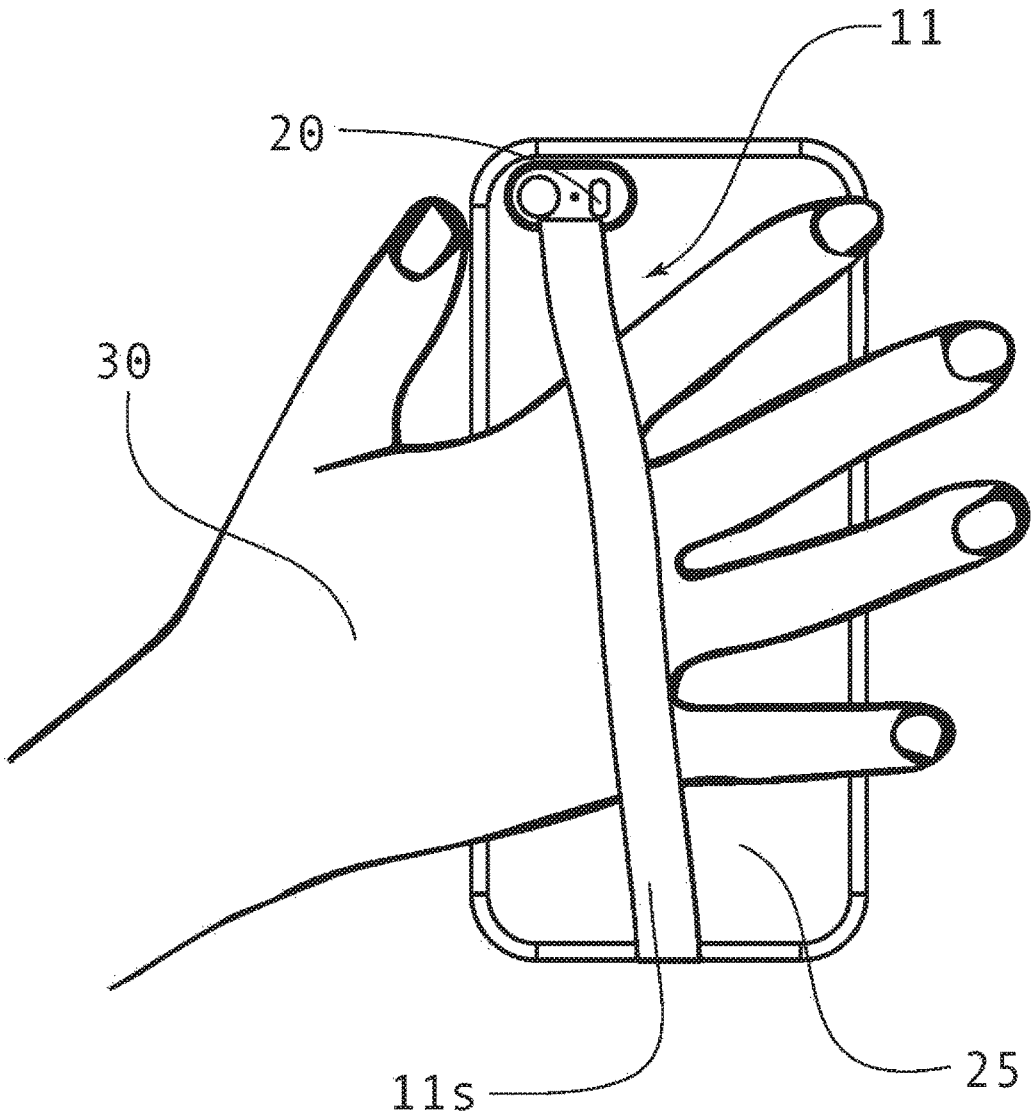
FIG. 11 is a back view of the assembly of the example back strap loop of FIG. 9A, example protective case of FIG. 9A, and example smartphone of FIG. 9A and the interaction with a hand, provided according to an embodiment of the present application.

FIG. 10 is a perspective view of the assembly of the example back strap loop 11, example handheld protective case 25, and example smartphone of FIG. 9A, provided according to an embodiment of the present application. In alternative embodiments, the opening in the protective case 25*h* that is used to receive the handheld device 20 is used for at least one, and possibly both ends of the back strap 11*s* having respective back strap self-adhesive layer 11*a* at each end. For example, instead of going through the data port opening in the protective case 25*h*, the bottom end of the back strap 11*s* could go under the bottom of the handheld protective case 25, and be affixed to the inside face of the protective case 25*b* through the main front opening in the protective case 25*h* intended to receive the handheld device 20. Similarly, although not expressly shown in the drawing, instead of going through the camera opening in the protective case 25*h*, the top end of the back strap 11*s* could go over the top of the handheld protective case 25, and be affixed to the inside face of the protective case 25*b* through the main front opening in the protective case 25*h* intended to receive the handheld device 20. Furthermore, although not expressly shown in the drawing, back strap loop 11 can be formed by affixing back strap 11*s* onto itself, in the manner of a wristband, such that the back strap 11*s* acts as the workpiece, either alone, or in combination with the handheld protective case 25. For example, if one of the two self-adhesive layer 11*a* is placed on one side of the back strap 11*s*, and the other self-adhesive layer 11*a* is placed on the other side of the back strap 11*s*, folding-over back strap 1 is after having passed one end through the camera protective opening 25*h* and the other end through either the main or data port protective opening 25*h*, results in an assembly wherein the back strap loop 11 can be freely slid while assembled to the handheld protective case 25 when the handheld device 20 is not inserted into the handheld protective case 25, and more solidly affixed so as not to slide when the handheld device 20 is inserted into the handheld protective case 25. Advantageously, if the two self-adhesive layer 11*a* overlap, this results in a very strong loop 11. Further still, if a portion of either of the two self-adhesive layer 11*a* is left without overlapping onto the other self-adhesive layer 11*a*, the non-overlapping portion can be used to prevent sliding of the loop 11 by affixing the loop 11 to the handheld protective case 25, the handheld device 20, or both. FIG. 11 is a back view of the assembly of the example back strap loop 11 of FIG. 9A, example protective case of FIG. 9A, and example smartphone of FIG. 9A and the interaction with a hand 30, provided according to an embodiment of the present application. Advantageously, the size of the loop 10 is adjustable to the size of the hand 30 such that the proper fit can be achieved for a particular purpose by the end user. For example, the remaining portion of the back strap loop 11 between the two opening in the case can be lengthened or shortened by moving the relative position on the inside face of the protective case 25*b* where each of the back strap 11*s* self adhesive layer is affixed. Advantageously, the back strap loop 11 thus formed may enable single-handed use for some handheld devices that would otherwise be awkward to manipulate with one hand 30, such as larger smartphones, phablets, tablets, etc. (ex: iPhone 6™, Galaxy Note™, iPad™ . . . ), as well as improving single-handed use for other handheld devices by allowing a more stable and relaxed grip for extended uses, such as photography, data taking, emailing and the like. The phone may also hold by itself onto one's hand when properly fitted.

Figure 12:
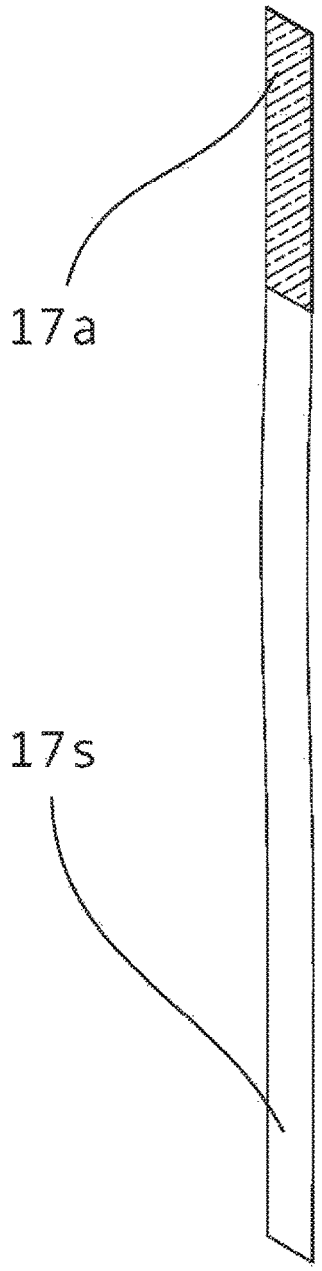
FIG. 12 is a perspective view of an example single end self-adhesive strap, provided according to an embodiment of the present application.

FIG. 12 is a perspective view of an example single end self-adhesive strap 17*s*, provided according to an embodiment of the present application. As illustrated, the single end self-adhesive strap 17*s* has the advantage that it is very simple to manufacture, and can be further processed to produce many embodiments of the present application. Advantageously, the single end self-adhesive strap 17*s* has a single end self-adhesive layer 17*a* (at least one affixing portion, strap-affixing portion) at one end, and the remainder of the single end self-adhesive strap 17*s* is provided without a self-adhesive layer. A loop 10 can be provided by folding over the single end self-adhesive strap 17*s* such that the bottom end is brought up towards the top end and at least a portion of the remainder of the single end self-adhesive strap 17*s* is put in contact with the single end self-adhesive layer 17*a* provided at the top end thereby forming a top and a bottom end of a loop 10. If the two ends of the single end self-adhesive strap 17*s* are substantially flush when forming the top end of the loop 10, then providing additional adhesive on the top end of the loop 10 may be required for some applications. Alternatively, if the two ends of the single end self-adhesive strap 17*s* are offset such that a portion of the single end self-adhesive layer 17*a* is exposed, the exposed portion thereby forms the strap self-adhesive layer 10*a* of the loop 10. Alternatively still, if a slit is cut in the remaining portion of the single end self-adhesive strap 17*s*, then a flat strap loop 14 is provided. Further alternatively, if the bottom end of the single end self-adhesive strap 17*s* is provided with a second single end self-adhesive layer 17*a*, then a double end self-adhesive strap 13*s* is provided from which yet further alternative embodiments can be provided, as will be described in reference to the next figure. Although not expressly shown in the drawing, it is contemplated to place the self-adhesive layer 17*a* (at least one affixing portion, strap-affixing portion) at any place on the flat strap 17*s*, such as the top end, bottom end, or anywhere in-between, on the front side or on the back side; furthermore it is contemplated that the self-adhesive layer can take any shape or form. Furthermore, although not expressly shown in the drawing, single end self-adhesive strap 17*s* can be formed into a loop by affixing back strap 17*s* onto itself, in the manner of a wristband, such that the single end self-adhesive strap 11*s* acts as a workpiece, either alone, or in combination with a handheld protective case. For example, if the self-adhesive layer 17*a* is placed on one side of the back strap 11*s*, folding-over single end self-adhesive strap 17*s* after having passed one end through the camera protective opening of a handheld protective case and the other end through either the main or data port protective case opening results in an assembly wherein the single end self-adhesive loop can be freely slid while assembled to the handheld protective case when the handheld device is not inserted into the handheld protective case, and more solidly affixed so as not to slide when the handheld device is inserted into the handheld protective case. Further still, if a portion of the self-adhesive layer is left without overlapping onto the remainder of the single end self-adhesive strap, the non-overlapping portion can be used to prevent sliding of the loop by affixing the loop to the handheld protective case, the handheld device, or both.

Figure 13:
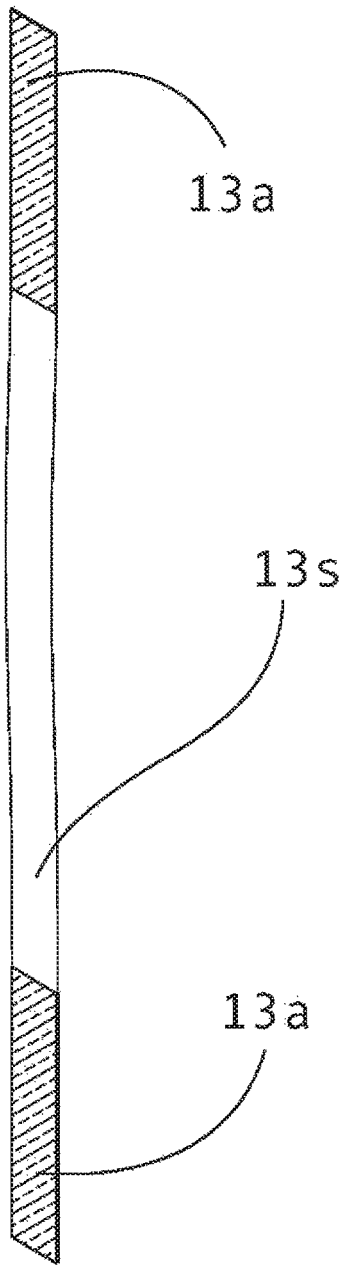
FIG. 13 is a perspective view of an example double end self-adhesive strap, provided according to an embodiment of the present application.

FIG. 13 is a perspective view of an example double end self-adhesive strap 13*s*, provided according to an embodiment of the present application. As illustrated, the double end self-adhesive strap 13*s* has the advantage that it is very simple to manufacture, and can be further processed to produce many embodiments of the present application. In fact, the strap 13 may be manufacture from the same continuous roll of 17*s* in FIG. 12 by simply shifting the cut so that 17*a* is cut in half. Advantageously, the double end self-adhesive strap 13*s* has two double end self adhesive layer each provided at both ends of the double end self-adhesive strap 13*s*, and the remainder of the double end self-adhesive strap 13*s* is provided without a self-adhesive layer. A loop 10 can be provided by folding over the double end self-adhesive strap 13*s* such that the bottom end is brought up towards the top end and at least a portion of the remainder of the double end self-adhesive strap 13*s* is put in contact with the double end self-adhesive layer 13*a* (at least one affixing portion, strap-affixing portion) provided at the top end thereby forming a top and a bottom end of a loop 10. If the two ends of the double end self-adhesive strap 13*s* are substantially flush when forming the top end of the loop 10, then providing additional adhesive on the top end of the loop 10 may be required in some applications. Alternatively, if the two ends of the double end self-adhesive strap 13*s* are offset such that a portion of at least one of the double end self-adhesive layer 13*a* is exposed, the exposed portion thereby forms the strap self-adhesive layer 10*a* of the loop 10. Alternatively still, if the double end self-adhesive strap 13*s* is folded at both the top and bottom end, then a back strap 11*s* and back strap loop 11 is provided as described in FIGS. 9-13. Although not expressly shown in the drawing, it is contemplated to place each of the self-adhesive layers 13*a* (at least one affixing portion, strap-affixing portion) at any place on the flat strap 13*s*, such as the top end, bottom end, or anywhere in-between, on the front side or on the back side; furthermore it is contemplated that the self-adhesive layer can take any shape or form.

Some further alternative embodiments will be described. One embodiment comprises a flexible loop 10 that holds via adhesive onto a smartphone or its protective casing, and serves as a strap 10*s* for ease of grabbing. One embodiment enhances one-handed manipulation of the handheld device and prevents the handheld device from accidental drops. Optional microfiber patch 10C may also hold acronyms, slogans, patterns, logos, symbols, brand marks, etc. Material may also be Tyvek™, plastic or vinyl like wristbands for public events. One design could also satisfy all applications. A ribbon with adhesive on both ends could be installed as a hanging loop 10, FIG. 1, or as a back strap loop 11, as on FIG. 11. The loop 10 would then pass through openings in the protective case, such as for camera and data port. Dimensions of the loop 10, back strap loop 11, and flat strap loop 14 may be of any size appropriate for a specific application. Accessories may be added to the apparatus, such as rings, clips, ornaments, reels, leashes, chains, etc. For example, adding a key ring 70 would allow a user to slip a finger into the ring to quickly secure the device. Although not expressly shown in the drawing, it is contemplated that embodiments of the present application enable a handheld device to be hung, supported, or otherwise configured so as to render the handheld device hands-free or hands-relaxed. For example, some embodiments of a loop enable a handheld device to be propped up onto any number of items that are readily available (pencils, erasers, coat hangers, hooks, fingers, etc.). The propping up of a handheld device in this manner is ideal for viewing content on the screen of the device in either a hands-free or hands-relaxed fashion. On the latter point, a loop affixed to a handheld device can be placed on a hand such that a portion of the hand (e.g. one or more fingers) uses the loop to support the handheld device without having to clasp the handheld device to keep it from falling, thereby resulting in a hands-relaxed use of the handheld device. Although not expressly shown in the drawing, material of the loop is one of at least, elastic, inelastic, plastic, polyester ribbon, microfiber, card, paper, kraft paper, and high-density polyethylene fibres.

Since other modifications and changes varied to fit particular operating requirements and environments will be apparent to those skilled in the art, what is desired to be protected by Letters Patent is not considered limited to the example chosen for purposes of disclosure, and covers all changes and modifications which do not constitute departures from the true spirit and scope of this application, which is set forth in the claims.

What is claimed is:

1. A loop apparatus for secure manipulation of a protective case for a handheld device, the protective case including at least one existing opening corresponding to existing features of the handheld device including at least one of an existing main opening for receiving the handheld device, an existing data port opening, an existing speaker opening, an existing camera opening, or an existing other opening, the handheld device having a front side and a back side, the protective case having an inside and an outside, the apparatus comprising:

a strap having a flat shape of predetermined thickness, width and length thereby delimiting a front side of the strap, a backside of the strap, two ends of the strap, and a middle portion of the strap between the two ends;

a manipulative portion of the loop provided in the middle portion of the strap on the outside of the protective case to facilitate manipulation, the manipulative portion further including at least one fold provided in the middle portion of the strap, the at least one fold configured such that each of the two ends of the strap is passable through the at least one existing opening in the protective case so as to reach the inside of the protective case; and an operative portion of the loop provided in at least one of the two ends of the strap on the inside of the protective case to secure the loop, the operative portion including at least one adhesive layer provided on the at least one of the two ends of the strap, the at least one adhesive layer adherable onto at least one of the inside of the protective case, the back of the handheld device, the front side of the strap, or the backside of the strap;

wherein the operative portion of the loop is squeezed between the inside of the protective case and the back side of the handheld device when the handheld device is inserted into the main opening of the protective case thereby securing the loop to the handheld device and protective case while leaving the manipulative portion of the loop at the outside of the protective case to facilitate manipulation of the handheld device and protective case.

2. The loop apparatus of claim 1, wherein the at least one fold provided in the middle portion of the strap includes only one fold.

3. The loop apparatus of claim 1, wherein the at least one fold provided in the middle portion of the strap includes only two folds.

4. The loop apparatus of claim 1, wherein at least one of the two ends passes through one of the existing data port opening, the existing speaker opening, or the existing other opening of the protective case.

5. The loop apparatus of claim 1, wherein one of the two ends passes through one of the existing camera opening or the existing other opening of the protective case.

6. The loop apparatus of claim 1, wherein at least one of the two ends passes through the existing main opening of the protective case.

7. The loop apparatus of claim 1, wherein the two ends of the strap overlap with one another and the at least one adhesive layer includes a portion to adhere the two ends of the strap to one another.

8. The loop apparatus of claim 7, wherein a portion of the at least one adhesive layer is left uncovered by the overlap of the two ends so that the uncovered portion adheres to at least one of the back of the handheld device or the inside of the protective case.

9. The loop apparatus of claim 1, wherein each of the two ends of the strap pass through a respective first and second of the at least one existing opening in the protective case.

10. The loop apparatus of claim 1, wherein one of the two ends of the strap passes through one of the existing data port opening, the existing speaker opening, the existing other opening, or the existing main opening and the other of the two ends of the strap passes through one of the existing main opening, the existing camera opening, or the existing other opening.

11. The loop apparatus of claim 1, wherein each of the two ends of the strap pass through the existing main opening of the protective case.

12. The loop apparatus of claim 1, further comprising a packaging element including a card.

13. The loop apparatus of claim 1, wherein the strap of the loop includes one of elastic material, inelastic material, plastic material, polyester ribbon, microfiber, card, paper, kraft paper, high-density polyethylene fibres, vinyl, leather, or Tyvek™.

14. The loop apparatus of claim 1, further comprising instructions on a card for using the loop with the protective case and the handheld device.

15. The loop apparatus of claim 1, wherein the at least one self adhesive layer includes a first self adhesive layer provided at one of the two ends of the strap and a second adhesive layer provided at the other of the two ends of the strap.

16. The loop apparatus of claim 1, wherein the at least one fold is one of a simple fold or a cross fold.

17. The loop apparatus of claim 1, wherein at least one of the ends of the strap has a tip that includes one of an angle cut, V cut, straight cut, glue, or fold.

18. The loop apparatus of claim 1, wherein a portion of the loop matches an exterior profile of curvature of the handheld device.

19. The loop apparatus of claim 1, wherein the strap includes for promotional purposes a pattern, color, texture, brand mark, logo, drawing, writing, identification, trademark, branding icon, acronym or slogan.

20. The loop apparatus of claim 1, wherein the strap includes an accessory including one of a bead, ring, clip, ornament, reel, leash, chain, leather strap, or key ring.

21. The loop apparatus of claim 1, further including a clasp that wraps around the strap like a tube.

22. The loop apparatus of claim 1, wherein the self adhesive layer is non-permanent and non-marking so an integrity of at least one of the handheld device or protective case is preserved.

23. A loop apparatus for secure manipulation of a protective case for a handheld device, the protective case including at least one existing opening corresponding to existing features of the handheld device including at least one of an existing main opening for receiving the handheld device, an existing data port opening, an existing speaker opening, an existing camera opening, or an existing other opening, the handheld device having a front side and a back side, the protective case having an inside and an outside, the apparatus comprising:

a strap having a flat shape of predetermined thickness, width and length thereby delimiting a front side of the strap, a backside of the strap, two ends of the strap, and a middle portion of the strap between the two ends;

a manipulative portion of the loop provided in the middle portion of the strap on the outside of the protective case to facilitate manipulation, the manipulative portion further including two folds provided in the middle portion of the strap, each fold configured such that each of the two ends of the strap is passable through the at least one existing opening in the protective case so as to reach the inside of the protective case; and an operative portion of the loop provided in at least one of the two ends of the strap on the inside of the protective case to secure the loop, the operative portion including at least one adhesive layer provided on the at least one of the two ends of the strap, the at least one adhesive layer adherable onto at least one of the inside of the protective case, the back of the handheld device, the front side of the strap, or the backside of the strap;

wherein the operative portion of the loop is squeezed between the inside of the protective case and the back side of the handheld device when the handheld device is inserted into the main opening of the protective case thereby securing the loop to the handheld device and protective case while leaving the manipulative portion of the loop at the outside of the protective case to facilitate manipulation of the handheld device and protective case.

24. A loop method for secure manipulation of a protective case for a handheld device, the protective case including at least one existing opening corresponding to existing features of the handheld device including at least one of an existing main opening for receiving the handheld device, an existing data port opening, an existing speaker opening, an existing camera opening, or an existing other opening, the handheld device having a front side and a back side, the protective case having an inside and an outside, the method comprising:

providing a strap having a flat shape of predetermined thickness, width and length thereby delimiting a front side of the strap, a backside of the strap, two ends of the strap, and a middle portion of the strap between the two ends;

providing a manipulative portion of the loop in the middle portion of the strap on the outside of the protective case to facilitate manipulation, the manipulative portion further including at least one fold provided in the middle portion of the strap, the at least one fold configured such that each of the two ends of the strap is passable through the at least one existing opening in the protective case so as to reach the inside of the protective case; and providing an operative portion of the loop in at least one of the two ends of the strap on the inside of the protective case to secure the loop, the operative portion including at least one adhesive layer provided on the at least one of the two ends of the strap, the at least one adhesive layer adherable onto at least one of the inside of the protective case, the back of the handheld device, the front side of the strap, or the backside of the strap;

wherein the operative portion of the loop is squeezed between the inside of the protective case and the back side of the handheld device when the handheld device is inserted into the main opening of the protective case thereby securing the loop to the handheld device and protective case while leaving the manipulative portion of the loop at the outside of the protective case to facilitate manipulation of the handheld device and protective case.

* * * * *